United States Patent [19]

Hanakawa et al.

[11] Patent Number: 4,863,533

[45] Date of Patent: Sep. 5, 1989

[54] APEX SEAL FOR ROTARY PISTON ENGINE AND METHOD FOR MANUFACTURING THE SAME

[75] Inventors: Katsunori Hanakawa, Hiroshima; Ken Okazaki, Higashihiroshima; Yasuo Uosaki, Hiroshima, all of Japan

[73] Assignee: Mazda Motor Corporation, Hiroshima, Japan

[21] Appl. No.: 117,497

[22] Filed: Nov. 6, 1987

[30] Foreign Application Priority Data

Nov. 7, 1986 [JP] Japan ..... 61-265324

[51] Int. Cl.[4] ..... C21D 5/00

[52] U.S. Cl. ..... 148/141; 148/321; 148/903

[58] Field of Search ..... 148/141, 143, 144, 903, 148/902, 4, 321, 14; 418/178, 179

[56] References Cited

U.S. PATENT DOCUMENTS 3,658,451 4/1972 Gomada ..... 418/178
4,000,011 12/1976 Sato et al. ..... 148/4
4,025,366 5/1977 Ruf et al. ..... 148/321
4,153,477 5/1979 Beyer et al. ..... 418/178

FOREIGN PATENT DOCUMENTS 48-25290 7/1973 Japan .
0133868 8/1984 Japan ..... 148/903

*Primary Examiner*—S. Kastler
*Attorney, Agent, or Firm*—Fleit, Jacobson, Cohn, Price, Holman & Stern

[57] ABSTRACT

An apex seal consisting of 3.0 to 4.0 wt % of C, 1.5 to 2.5 wt % of Si, 0.3 to 1.0 wt % Mn, 0.05 to 0.3 wt % of P, less than 0.1 wt % of S, 0.005 to 0.025 wt % of Mg or Ce, 0.5 to 2.0 wt % of Cu and/or 0.5 to 3.0 wt % of Ni, 0.4 to 1.0 wt % of Cr, 1.0 to 2.0 wt % of Mo and/or 0.1 to 0.5 wt % of V with the balance of Fe, being formed in the sliding surface portion with a sorbite matrix structure in which carbides are dispersed in a matrix of sorbite and in the matrix portion of the material other than the sliding surface portion with a sorbite structure. The apex seal has an excellent bending strength and wear resistance.

6 Claims, 3 Drawing Sheets

(x 4000)

(x 4000)

(x 4000)

(x 4000)

(x4000)

(x 4000)

APEX SEAL FOR ROTARY PISTON ENGINE AND METHOD FOR MANUFACTURING THE SAME

BACKGROUND OF THE INVENTION

1. Field of the invention

The present invention relates to an apex seal for rotary piston engines and a method for manufacturing the same, more particularly to an apex seal having an improved wear resistance and, strength or toughness, specifically against bending moment.

2. Description of the Prior art

The apex seal for a rotary piston engine is fitted at the apex of the rotary piston and is adapted to make a planetary motion with the piston while being exposed to heated gas and subjected to various forces in the operating chamber. Thus, it is necessary for the apex seal of the rotary piston engines to have a sufficient wear and heat resistances and the like.

In the field of rotary piston engine, conventionally a cast iron of which surface is chilled to form a hardened layer so-called chilled structure by means of an electron beam is employed for the apex seal as disclosed in U.S. Pat. No. 3,658,451 so that an excellent sliding contact property can be obtained between a trochoidal surface of rotor housing and the apex seal.

Recently, there has been increased the requirement for a high power rotary piston engine. For this purpose, it is desirable to provide the apex seal with a low sliding resistance and light weight by providing a compact configuration, for instance by reducing the thickness. It should however be noted that if the thickness of the apex seal is decreased, the load acted on the apex seal will be unduly increased because the apex seal is used under such severe condition as mentioned above.

In this regard, an idea is proposed that an apex seal of which sliding surface is chilled to be hardened may be applied for such high power rotary piston engine. It should however be noted that although the surface portion of the apex seal has an improved wear resistance through the chilling treatment, the boundary portion between the chilled portion and the matrix portion thereof other than the chilled portion forms a coarse martensite structure and becomes brittle by the heat affect induced by the high energy heating beam. The main portion or matrix portion of the apex seal other than the chilled portion is of a bainite structure produced through a mere casting treatment without any additional treatment wherein some alloy elements constituting the apex seal produce a certain segregation to make a heterogeneous structure to thereby decrease the strength. Further the difference between the chilled portion and the matrix portion of the material other than the chilled portion in hardness, and in structure causes the binding strength therebetween to weaken so that the apex seal may be broken during operation of the rotary piston engine.

SUMMARY OF THE INVENTION

It is therefore an object of the present invention to provide an apex seal of an improved strength and wear resistance.

It is another object of the present invention to provide a compact and light apex seal which can improve the power output of the rotary piston engines.

It is further object of the present invention to provide the sliding surface portion subjected to the chilling treatment of the apex seal material with a sorbite matrix structure where carbides are dispersed in matrix of sorbite, and provide the matrix portion of the apex seal other than the surface portion with a sorbite structure.

According to the present invention, there is provided an apex seal mounted on the corners of a rotor and adapted to be brought into a sliding contact with a rotor housing of a rotary piston engine, consisting of 3.0 to 4.0 wt % of C, 1.5 to 2.5 wt % to 2.5 wt % of Si, 0.3 to 1.0 wt % Mn, 0.05 to 0.3 wt % of P, less than 0.1 wt % of S, 0.005 to 0.025 wt % of Mg or Ce, 0.5 to 2.0 wt % of Cu and/or 0.5 to 3.0 wt % of Ni, 0.4 to 1.0 wt % of Cr, 1.0 to 2.0 wt % of Mo and/or 0.1 to 0.5 wt % of V with the balance of Fe, being formed in the sliding surface portion with a sorbite matrix structure where carbides such as $Fe_3C$ and FeC are dispersed in matrix of sorbite, and in the matrix portion of the material other than the sliding surface portion with a sorbite structure.

According to the present invention, the apex seal can be obtained through a method comprising steps of preparing a cast iron alloy blank of a bainite structure consisting of 3.0 to 4.0 wt % of C, 1.5 to 2.5 wt % of Si, 0.3 to 1.0 wt % Mn, 0.05 to 0.3 wt % of P, less than 0.1 wt % of S, 0.005 to 0.025 wt % of Mg or Ce, 0.5 to 2.0 wt % of Cu and/or 0.5 to 3.0 wt % of Ni, 0.4 to 1.0 wt % of Cr, 1.0 to 2.0 wt % of Mo and/or 0.1 to 0.5 wt % of V with the balance of Fe, and applying a high energy heating radiation to the sliding surface portion of the blank to form a hardened layer or chilled structure on the surface, then heating and quenching the blank at the temperature of 800° to 900° C. for less than 30 minutes to form a martensite matrix structure in the sliding surface portion of the blank where carbides are dispersed in matrix of martensite, and a martensite structure in the portion other than the surface portion, and thereafter tempering the blank under a predetermined condition so that a sorbite matrix structure in the sliding surface portion of the blank where carbides are dispersed in sorbite, and a sorbite structure in the matrix portion of the blank other than the sliding surface potion. The criticality of the these components of the apex seal material is described below.

When the C content is lower than 3.0 wt %, the amount of the carbide is unduly reduced so that the wear resistant property of the apex seal is deteriorated. Whereas, in the case where the C content exceeds 4.0 wt %, initial graphite nuclei grow to large scale graphite particles through the casting treatment to harm the strength and wear resistance of the material.

When the Si content is less than 1.5 wt %, the casting property becomes worse and tends to produce carbides during the casting treatment without any additional treatment to thereby make the machining treatment hard. On the other hand, when the Si content is higher than 2.5 wt %, there produce a large amount of free graphite particles during the chilling treatment so that the wear resistance of the resulting products is deteriorated.

Mn is included in the range of 0.3 to 1.0 wt %. When the Mn content is lower than 0.3 wt %, the hardenability of the material becomes insufficient. When it is included higher than 1.0 wt %, the segregation tendency is enhanced in the grain boundary to promote a heterogenity so that the toughness of the resulting product is reduced.

P is an element which improves the wear resistant property of the products through the chilling treatment. When the P content is lower than 0.05 wt %, the effect improving the wear resistant property of the products cannot be obtained. While, when it is included more than the 0.3 wt %, a steadite structure produces in the matrix of the material to weaken the strength of the products.

It is preferred that The content of S inevitably contained in the molten material should be suppressed below 0.1 wt % because a large amount of S is harmful for maintaining a desired strength.

Elements Mg and Ce are included as deoxidizer in the molten material. When the content of Mg and Ce are lower than 0.005 wt %, the effect as the deoxidizer cannot be obtained so that there is a possibility of producing a large amount of blow holes during the chilling treatment. While, when Mg and Ce are included more than 0.025 wt %, there occurs spattering during the chilling treatment to thereby roughen the bead surface on the chilled portion.

Cu has an effect for supressing the crystallization of carbides. When the content of Cu is lower than 0.5 wt %, such effect of Cu cannot be obtained. Whereas such effect of Cu is saturated and a segregation occurs to reduce the strength of the resulting products when the content of Cu is higher than 2.0 wt %.

Ni is preferably included within a range of 0.5 to 3.0 wt % for suppressing the crystallization of carbides as well as Cu. When Ni is included lower than 0.5 wt %, the crystallization of the carbides cannot be suppressed efficiently. When Ni content exceeds 3.0 wt %, the effect is saturated with an increase of manufacturing cost.

Cr is included within the range of 0.4 to 1.0 wt % for improving the wear resistant property. When the content is lower than 0.4 wt %, such effect cannot be obtained. While the effect is saturated when the content exceeds 1.0 wt % and a segregation of Cr occurs as a form of carbide in the grain boundaries of the matrix portion or main body of the apex seal blank so that the machining property is deteriorated and the strength of the resulting products are decreased.

Mo is included for increasing hardness of the chilled portion to thereby improve the wear resistance of the material as well as Cr. However, when Mo is included less than 1.0 wt %, such effect cannot be obtained. While the effect is saturated when the content exceeds 2.0 wt % and a segregation of Mo produces as a form of carbide in the grain boundaries of the matrix portion or main body of the apex seal blank so that the machining property is deteriorated and the strength of the resulting products are decreased.

V is included for increasing hardness of the chilled potion to thereby improve the wear resistance of the material as well as Cr and Mo.

The desirable range of V included is 0.1 to 0.5 wt % for same reasons as Cr and Mo.

As described above, the heating for hardening and quenching treatment is carried out at the temperature of 800° to 900° C. When the temperature is lower than 800° C., it becomes difficult to perform a homogeneous and stable austenitizing of the chilled portion. On the other hand, a decomposition of the structure through the chilling treatment takes place abruptly to deteriorate the wear resistance of the resulting products. The heating time for the hardening and quenching treatment is preferably suppressed within approximately 30 minutes because the carbide structure in the chilled portion may be decomposed to reduce the wear resistance.

The tempering temperature is preferably carried out within 300° to 550° C. When the temperature is lower than 300° C., it difficult to change sufficiently from the martensite structure to sorbite structure through the tempering treatment so that the resulting products become brittle. While the hardness is decreased in the chilled portion and the matrix portion or the portion other than the chilled portion of the material when the tempering temperature is higher than 550° C. so that the wear resistance of the resulting products is reduced. Meanwhile, the time for tempering is selected within a range of 10 minutes to 4 hours. This is because the material does not change to a sorbite structure effectively when the time is shorter than 10 minutes so that the resulting products become brittle and the hardness the material is decreased when the tempering time exceeds 4 hours so that the wear resistance is lowered.

The apex seal obtained by means of the present invention has a sorbite matrix structure in the chilled surface portion thereof in which carbide particles are dispersed in a matrix of sorbite and has a sorbite structure in the matrix portion or main body portion other than the chilled surface portion thereof so that an improved wear resistance is obtained in the chilled surface portion and an improved strength is obtained specifically against bending moment.

BRIEF DESCRIPTION OF THE DRAWINGS

FIG. 4(*b*) is a photograph of the boundary portion between the chilled portion and the matrix portion or portion other than the chilled portion of Example A1 taken by a photomicroscope of 4000 magnifications;

FIG. 4(*c*) is a photograph of the matrix portion of Example A1 taken by a photomicroscope of 4000 magnifications;

FIG. 5(b) is a photograph of the boundary portion between the chilled portion and the matrix portion of Prior art B3 taken by a photomicroscope of 4000 magnifications;

FIG. 5(*c*) is a photograph of the matrix portion of Prior art B3 taken by a photomicroscope of 4000 magnifications.

DESCRIPTION OF THE PREFERRED EMBODIMENTS

Hereinafter there is a detailed description of preferred embodiments of the present invention.

Figure 1:
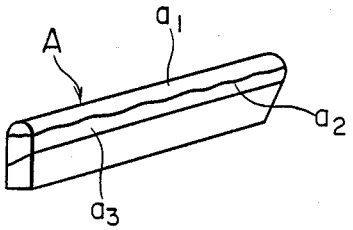
FIG. 1 is a perspective view of an apex seal for rotary piston engines in accordance with the present invention.

Referring to FIG. 1, there is shown an apex seal which is adapted to be mounted on the corners of a rotor and brought into a sliding contact with the inner surface of a rotor housing. The apex seal illustrated in FIG. 1 is of a two piece type apex seal. The present invention can b applied for one piece A constituting the apex seal which is adapted to contact with the surface of the rotor housing.

Materials for making the piece A of the apex seal consisting of components showing in Table 1 were molten and casted. Thereafter, for chilling treatment, an electron beam was irradiated on the surface of the casted apex seal blanks to form a hardened layer or so-called chilled structure on the surface portion thereof which is brought into a sliding contact with the rotor housing of the rotary piston engine. Then the blanks of Examples A1, A2, A3, and A4, and of Prior Arts B1 and B2 were subjected to the hardening treatment at hardening temperature of 850° C. for 5 minutes, in turn, subjected to the tempering treatment at a tempering temperature of 470° C. for 2 and half hours, and finally a machining treatment were applied thereto whereby final products were obtained to be utilized as piece A of the apex seal. While the casted blank B3 was subjected to only the machining treatment without any hardening and tempering treatment to form a final product as an apex seal. In the Table 1, the indications of Fe content are omitted and numeral denotes the weight percentage of each component.

In FIG. 1, when the electron beam was irradiated on the sliding surface, a chilled portion or hardened layer a1 is formed on the surface portion of the blank. With regard to the blanks, the chilled portion or heat affected portion a1 was changed to a sorbite matrix structure in which carbide particles such as $Fe_3$ and FeC are dispersed in matrix of sorbite, and the matrix portion or main body portion a3 of the blank other than the chilled portion a1 and the boundary portion a2 between the chilled portion a1 and the matrix portion a3 are a sorbite structure in the final product of the apex seal.

TABLE 1

| | C | Si | Mn | P | S | Cu | Ni | Mo | Cr | V | Mg |
|---|---|---|---|---|---|---|---|---|---|---|---|
| Example (A1) | 3.50 | 2.35 | 0.40 | 0.25 | 0.03 | 1.10 | 0.95 | 1.53 | 0.52 | 0.20 | 0.021 |
| Example (A2) | 3.50 | 2.40 | 0.52 | 0.22 | 0.03 | 1.99 | 2.89 | 1.92 | 0.93 | 0.46 | 0.021 |
| Example (A3) | 3.60 | 2.09 | 0.35 | 0.01 | 0.02 | 1.08 | — | 1.47 | 0.55 | — | 0.018 |
| Example (A4) | 3.11 | 2.31 | 0.45 | 0.28 | 0.02 | — | 1.02 | 1.48 | 0.52 | — | 0.019 |
| Prior Art (B1) | 3.48 | 2.44 | 0.51 | 0.22 | 0.03 | 2.09 | 3.10 | 2.03 | 1.06 | 0.57 | 0.022 |
| Prior Art (B2) | 3.43 | 2.38 | 0.33 | 0.26 | 0.02 | 0.48 | 0.47 | 0.99 | 0.37 | 0.08 | 0.021 |
| Prior Art (B3) | 3.53 | 2.41 | 0.35 | 0.13 | 0.03 | 1.00 | 1.05 | 1.60 | 0.50 | 0.15 | 0.019 |

Figure 2:
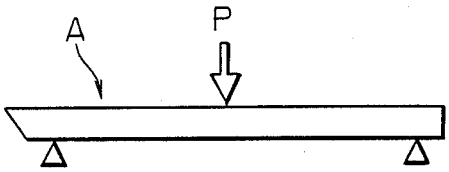
FIG. 2 is a schematic view showing a manner of testing the bending strength of the apex seal.
Figure 3:
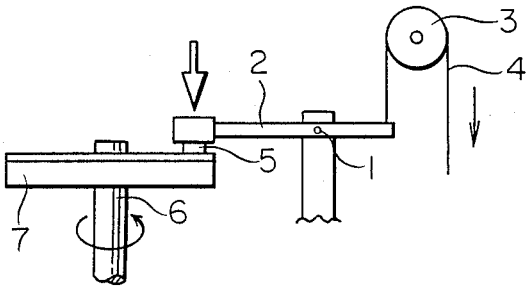
FIG. 3 is a schematic view of a testing device for testing the wear resistance of the apex seal materials.

With regard to the pieces A of the apex seal obtained through the above methods, a bending test and wear test were carried out thereon. The results are shown in Table 2. The bending test was carried out according to a manner that a load P was vertically applied to the test piece A of the apex seal at the middle portion thereof which is horizontally supported at both end portions as shown in FIG. 2. The bending strength is determined by measuring magnitude of the load P when the test piece is broken because of bending moment by load P. The wear test was carried out by using a test device as shown in FIG. 3. The device is provided with a rotation arm 2 which is pivotally supported by a shaft 1. The arm 2 is connected at one end with a wire 4 which is engaged with a pulley 3. The wire 4 is stretched by a weight to a direction of arrow as shown in FIG. 3. A test piece 5 having the same material as each of the piece A as mentioned above is mounted on the arm 2 at the other hand. Each of the test piece 5 is brought into contact with the surface of a disc 7 coated with Cr which is mounted on a rotation shaft 6. The amount of wear of the test piece 5 was measured after a certain rotating operating of the disc 7 for 20 minutes at the speed of 5 m/sec with a weight of 4.5 kg applied to the arm 2.

TABLE 2

| | Bending Strength kg | Abrasion Wear μm | Hardness Hv |
|---|---|---|---|
| Example (A1) | 106 | 88 | 613 |
| Example (A2) | 85 | 76 | 722 |
| Example (A3) | 103 | 101 | 582 |
| Example (A4) | 98 | 89 | 567 |
| Prior Art (B1) | 75 | 77 | 761 |
| Prior Art (B2) | 101 | 139 | 499 |
| Prior Art (B3) | 79 | 82 | 790 |

According to the result of the tests, the test pieces of Examples A1 through A4 have substantially the same amount of wear as those of Prior Arts B1 through B3. Thus, Examples A1 through A4 have substantially the same wear resistance as Prior Arts B1 through B3. As for the bending strength, Examples A1 through A4 is stronger than Prior Art B3. Specifically, the bending strength of Example A1 is 1.4 times that of Prior Art B1. Prior Art B1 can improve in the wear resistance because of production of hard carbide structure, however reduces in the bending strength. On the contrary, Prior art B2 is advantageous in the bending strength, however, lowered in the wear resistance because it cannot obtain a sufficient hardness by carbide.

In Table 3, there are shown similar test results. But the tests were conducted with regard to test pieces prepared under different hardening and tempering conditions from those of Example A1. The conditions for preparing test pieces of Examples A-1 through A-5 were set in accordance with the present invention. On the other hand, the preparing condition for Prior Art B-4 through B-8 does not satisfy the present invention. In Table 3, the upper side denotes hardening condition and the lower side denotes tempering condition in the blank of the preparing condition.

TABLE 3

| | Preparing Condition | Bending Strength kg | Abrasion Wear μm | Hardness Hv |
|---|---|---|---|---|
| Example (A-1) | 890° C. × 5 min.<br>470° C. ×2.5 Hr | 95 | 91 | 606 |
| Example (A-2) | 850° C. × 30 min.<br>470° C. × 2.5 Hr | 90 | 95 | 593 |
| Example (A-3) | 850° C. × 5 min.<br>530° C. × 2.5 Hr | 86 | 95 | 563 |
| Example (A-4) | 850° C. × 5 min.<br>320° C. × 2.5 Hr | 83 | 87 | 699 |
| Example (A-5) | 810° C. × 5 min.<br>470° C. × 2.5 Hr | 91 | 89 | 623 |
| Prior Art (B4) | 850° C. × 5 min.<br>250° C. × 2.5 Hr | 77 | 85 | 724 |
| Prior Art (B5) | 850° C. × 5 min.<br>470° C. × 8 min. | 75 | 89 | 730 |
| Prior Art (B6) | 850° C. × 5 min.<br>470° C. × 4.5 Hr | 70 | 90 | 610 |
| Prior Art (B7) | 790° C. × 5 min.<br>470° C. × 2.5 Hr | 76 | 88 | 736 |
| Prior Art (B8) | 910° C. × 5 min. | | | |

TABLE 3-continued

| Preparing Condition | Bending Strength kg | Abrasion Wear μm | Hardness Hv |
|---|---|---|---|
| 470° C. × 2.5 Hr | 95 | 132 | 524 |

Figure 4:
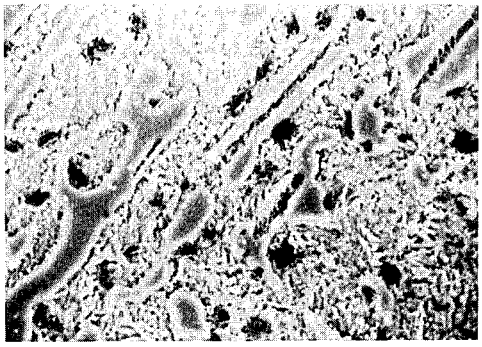
FIG. 4(*a*) is a photograph of the chilled portion of Example A1 in accordance with the present invention taken by a photomicroscope of 4000 magnifications.
Figure 4:
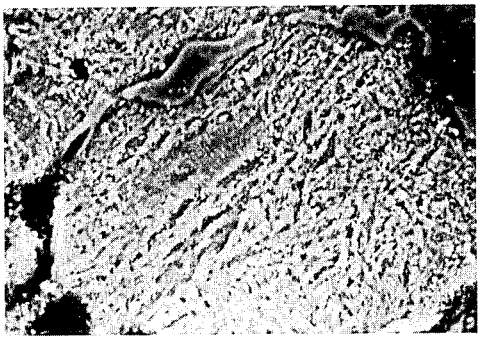
Figure 4:
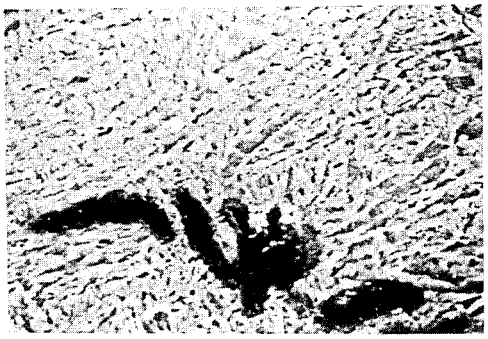
Figure 5:
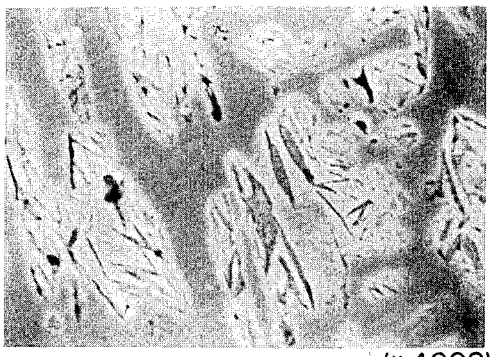
FIG. 5(*a*) is a photograph of the chilled portion of Prior art B3 taken by a photomicroscope of 4000 magnifications.
Figure 5:
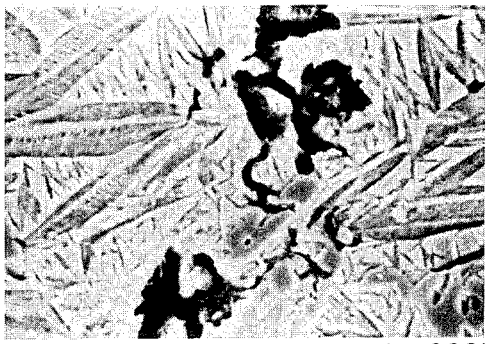
Figure 5:
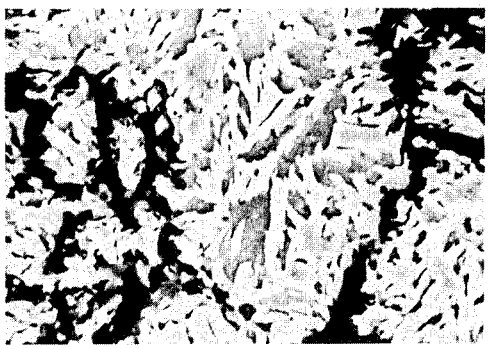

According to the test results of Table 3, the test pieces of Example A-1 through A-5 have substantially the same amount of wear as Prior Art B3. This means that they are substantially the same in the wear resistance. Further, Example A-1 through A-5 are improved in the bending strength. a sufficient sorbite structure is not produced in Prior Art B4 because the tempering temperature is too low so that Prior Art B4 decreases in the bending strength. Prior Art B5 is not formed with a sufficient sorbite structure because of unduly short tempering time of 8 minutes to lower the bending strength as well as Prior Art B4. Prior Art B6 was subjected to an unduly long tempering treatment soften in the matrix portion a3 so that the bending strength is reduced. As for Prior Art B7, although the amount of wear was small, a sufficient austenitizing could not be performed because the austenizing temperature of 790° C. is too low so that the structure became heterogeneous to thereby be lowered in the bending strength. On the other hand, Prior Art B8 is advantageous in the bending strength. However, the austenizing temperature of 910° C. applied thereto is too high so that the carbides were decomposed in the chilled portion a1 resulting in an increase of wear amount. As mentioned above, Examples A1 through A4 are superior to Prior Art B1 through B3 in both the bending strength and wear resistance. In order to prove this, there are shown in FIG. 4 and 5, photographs of the structure of Example A1 and Prior Art B3, which are magnified by 4000 times. As shown in FIG. 4(*a*) and 4(*c*), both the matrix material in the chilled portion a1 and the matrix portion a3 of Example A1 have a sorbite structure. Further, as shown in FIG. 4(*b*), the boundary portion a2, which is a heat affected zone by the irradiation of the electron beam in the chilling treatment, also has a sorbite structure. This means that the heat affect caused by the chilling treatment is eliminated in the boundary portion a2 of Example A1.

On the other hand, as shown in FIG. 5(*a*) and 5(*b*), both the chilled portion a1 and the boundary portion a2 of Prior Art B3 have a martensite structure. As shown in FIG. 5(*c*), the matrix portion a3 of Prior Art B3 has a bainite structure produced in the casting stage. The boundary portion a2 other than the portion a1 is reformed to a martensite structure by the heat affect of the irradiation of the electron beam and has a structure of coarse crystal particles.

As mentioned above, it will be understood that the materials in accordance with the present invention has an excellent wear resistance and bending strength and that they can be employed as an apex seal for a high power rotary piston engine effectively.

It is advantageous in that the apex seal according to the present invention can be provided by a simple way that the apex seal blank is subjected to a certain hardening and tempering treatment after casting.

We claim:

1. A method for manufacturing an apex seal for rotary piston engine comprising steps of preparing a cast iron alloy blank of a bainite structure consisting of 3.0 to 4.0 wt % of C., 1.5 to 2.5 wt % of Si, 0.3 to 1.0 wt % of Mn, 0.05 to 0.3 wt % of P, less than 0.1 wt % of S, 0.005 to 0.025 wt % of Mg or Ce, at least one of 0.5 to 2.0 wt % of Cu and 0.5 to 3.0 wt % of Ni, 0.4 to 1.0 wt % of Cr, 1.0 to 2.0 wt % of Mo with balance of Fe, applying a high energy heating radiation to the sliding surface portion of the blank to form a hardened structure on the sliding surface, then heating and quenching the blank at the temperature of 800° to 900 ° C. for less than 30 minutes to form a martensite matrix structure in the sliding surface portion of the blank in which carbides are dispersed in a matrix of martensite, and a martensite structure in the matrix portion of the blank other than the sliding surface portion, and thereafter tempering the blank so that a sorbite matrix structure in the sliding surface portion of the blank in which carbides are dispersed in a matrix of sorbite and a sorbite structure in the matrix portion of the blank other than the sliding surface portion are produced.

2. A method for manufacturing an apex seal in accordance with claim 1 in which the high energy heat radiation is an electron beam.

3. A method for manufacturing an apex seal in accordance with claim 1 in which the tempering temperature in set within a range of 300° to 550° C.

4. A method for manufacturing an apex seal for rotary piston engine comprising steps of preparing a cast iron alloy blank of a bainite structure consisting of 3.0 to 4.0 wt % of C, 1.5 to 2.5 wt % of Si, 0.3 to 1.0 wt % of Mn, 0.05 to 0.3 wt % of P, less than 0.1 wt % of S, 0.005 to 0.025 wt % of Mg or Ce, at least one of 0.5 to 2.0 wt % of Cu and 0.5 to 3.0 wt % of Ni, 0.4 to 1.0 wt % of Cr, 0.1 to 0.5 wt % of V with balance of Fe, applying a high energy heating radiation to the sliding surface portion of the blank to form a hardened structure on the sliding surface, then heating and quenching the blank at the temperature of 800° to 900° C. for less than 30 minutes to form a martensite matrix structure in the sliding surface portion of the blank in which carbides are dispersed in a matrix of martensite, and a martensite structure in the matrix portion of the blank other than the sliding surface portion, and thereafter tempering the blank so that a sorbite matrix structure in the sliding surface portion of the blank in which carbides are dispersed in a matrix of sorbite and a sorbite structure in the matrix portion of the blank other than the sliding surface portion are produced.

5. A method for manufacturing an apex seal for rotary piston engine comprising steps of preparing a cast iron alloy blank of a bainite structure consisting of 3.0 to 4.0 wt % of C, 1.5 to 2.5 wt % of Si, 0.3 to 1.0 wt % of Mn, 0.05 to 0.3 wt % of P, less than 0.1 wt % pf S, 0.005 to 0.025 wt % of Mg or Ce, at least one of 0.5 to 2.0 wt % of Cu and 0.5 to 3.0 wt % of Ni, 0.4 to 1.0 wt % of Cr, 1.0 to 2.0 wt % of Mo with balance of Fe, applying a high energy heating radiation to the sliding surface portion of the blank to form a hardened structure on the sliding surface, then heating and quenching the blank at the temperature of 800° to 900° C. for about 5 minutes to form a martensite matrix structure in the sliding surface portion of the blank in which carbides are dispersed in a matrix of martensite, and a martensite structure in the matrix portion of the blank other than the sliding surface portion, and thereafter tempering the blank so that a sorbite matrix structure in the sliding surface portion of the blank in which carbides are dispersed in a matrix of sorbite and a sorbite structure in the matrix portion of the blank other than the sliding surface portion are produced.

6. A method for manufacturing an apex seal for rotary piston engine comprising steps of preparing a cast iron alloy blank of a bainite structure consisting of 3.0 to 4.0 wt % of C, 1.5 to 2.5 wt % of Si, 0.3 to 1.0 wt % pf Mn, 0.05 to 0.3 wt % of P, less than 0.1 wt % of S, 0.005 to 0.025 wt % of Mg or Ce, at least one of 0.5 to 2.0 wt % of Cu and 0.5 to 3.0 wt % of Ni, 0.4 to 1.0 wt % of Cr, 0.1 to 0.5 wt % of V with balance of Fe, applying a high energy heating radiation to the sliding surface portion of the blank to form a hardened structure on the sliding surface, then heating and quenching the blank at the temperature of 800° to 900° C. for about 5 minutes to form a martensite matrix structure in the sliding surface portion of the blank in which the carbides are dispersed in a matrix of martensite, and a martensite structure in the matrix portion of the blank other than the sliding surface portion, and thereafter tempering the blank so that a sorbite matrix structure in the sliding surface portion of the blank in which carbides are dispersed in a matrix of sorbite and a sorbite structure in the matrix portion of the blank other than the sliding surface portion are produced.

* * * * *